US006198696B1

(12) United States Patent
Korpi et al.

(10) Patent No.: US 6,198,696 B1
(45) Date of Patent: Mar. 6, 2001

(54) DEVICE AND METHOD FOR TRACKING TIME ZONE CHANGES IN COMMUNICATIONS DEVICES

(75) Inventors: Markku Korpi, Cupertino; Shmuel Shaffer, Palo Alto; William Joseph Beyda, Cupertino, all of CA (US)

(73) Assignee: Siemens Information and Communication Networks, Inc., Boca Raton, FL (US)

( * ) Notice: Subject to any disclaimer, the term of this patent is extended or adjusted under 35 U.S.C. 154(b) by 0 days.

(21) Appl. No.: 09/334,779

(22) Filed: Jun. 16, 1999

(51) Int. Cl.[7] ..... G04B 19/22
(52) U.S. Cl. ..... 368/21
(58) Field of Search ..... 368/21–28, 31, 368/185–187

(56) References Cited

U.S. PATENT DOCUMENTS 4,995,020 * 2/1991 Mitchell ..... 368/185
5,089,814 * 2/1992 DeLuca et al. ..... 368/21
5,724,316 * 3/1998 brunts ..... 368/21
5,845,257 12/1998 Fu et al. .

* cited by examiner

*Primary Examiner*—Bernard Roskoski

(57) ABSTRACT

A portable processing device, such as a laptop computer, includes a time-of-day clock that is dynamically adjusted based upon occurrences of travel among different time zones. An itinerary is stored as a travel schedule of departure and arrival information and is used to identify anticipated multi-zone travel. When there is a coincidence between the clock and the occurrence of an anticipated multi-zone trip, the clock is automatically adjusted. The itinerary may be input via a user interface mechanism, such as a keyboard, may be entered by means of synchronization with a compatible program of a second device, or may be input via a network, such as the Internet. The determination of the relevant time zones preferably utilizes a database and most preferably utilizes an internal database of cities and time differentials among the cities. The dynamic adjustments of the time-of-day clock occur en route, without accessing externally generated signals or external devices.

18 Claims, 3 Drawing Sheets

DEVICE AND METHOD FOR TRACKING TIME ZONE CHANGES IN COMMUNICATIONS DEVICES

TECHNICAL FIELD

The invention relates generally to portable devices having time-of-day clocks and more particularly to techniques for updating time-of-day clocks of portable devices based upon travel of the devices.

DESCRIPTION OF THE RELATED ART

There are a variety of types of portable processing devices that maintain a time-of-day clock to assist a user or to manage certain functions of the device. For example, a laptop computer, palmtop computer, or a personal digital assistant (PDA) is typically enabled to display the time of day. As users become more reliant on a portable processing device, such as a laptop computer, and upon calendaring and messaging capabilities of the device, the precise time becomes more important. This is particularly true of local area network (LAN)-based telephony clients. For example, telephony over LAN (ToL) systems may be configured to forward or inhibit forwarding of telephone calls based upon the time of day. Whether the portable processing device is connected to a hotel LAN port, a phone port or a wireless system, accurate behavior of the functions of the device is increasingly dependent upon tracking the time of day for accurate behavior.

One concern is that portable devices are often used by individuals traveling among cities that are in different time zones. As a person enters a different time zone, the person can use one of the user interfaces of the device (e.g., a keyboard or computer mouse) to adjust the time-of-day clock. In order to facilitate the process, some personal information manager (PIM) programs with electronic calendars and some operating systems identify certain time zones and automatically compute the clock adjustment when a user selects one of the time zones. That is, the user selects a particular time zone in which the user and the device have been relocated, so that the device can automatically and immediately alter the time zone setting and the time/date of the electronic calendar. Even with the automated time zone adjustment, manual intervention by the user is required and is performed only at the time of traveling. If the user enters a scheduled teleconference that takes place in different time zones, the user must calculate the time difference and the appropriate day and time for entry into the electronic calendar. Since this process is sometimes difficult and prone to operator error, many travelers who carry laptops, PDAs, palmtop computers and similar devices often do not enter the time zone changes.

An improved system and method for scheduling and tracking events across multiple time zones is described in U.S. Pat. No. 5,845,257 to Fu et al. A device includes an electronic PIM having a calendar/scheduling system. In operation, the system tracks different types of times, such as local time, home time and remote time. "Home" time is determined by the time zone in which the user typically spends most of his or her time, such as the location of the home office of the user. "Local" time is the time for the locality in which the user is physically present at any particular instance. "Remote" time represents the time zones of particular other individuals. The system may show events and appointments in the user's own local time, regardless of the location in which the user is presently located. Identifying the three different times, the system provides an improved means for managing activities, such as phone conferences across multiple time zones.

Using the Fu et al. system and method, upon arriving in a new time zone, the "local" time of the system is either automatically or manually adjusted. The automatic adjustment may be performed by using broadcasted reference signals, such as the Public Broadcasting Station (PBS) time signal, or using Global Positioning System (GPS) signals or the like. The manual approach may be performed by the user specifying the new time zone or by the system detecting that the user has set the system clock to a new time. The calendar/scheduling system then updates scheduled events by looping through each event record or entry and normalizing the time entry to Greenwich Mean Time (GMT). The normalized time entries are then converted to the new "local" time.

While the Fu et al. system reduces the complexities of time zone adjustments, user intervention is still required, if the device is not enabled to determine the present time zone by using PBS or GPS signals that are wirelessly received. What is needed is a device and method for providing automated time zone tracking of the present location of the device, without requiring reception of location-specific signals.

SUMMARY OF THE INVENTION

A portable processing device includes a time-of-day clock that is adjusted dynamically in accordance with a travel schedule that is stored in memory. The travel schedule is a stored itinerary that includes departure and arrival information. When it is determined that the itinerary identifies travel that includes at least two time zones, the time-of-day clock is updated to have a correlation with the departure and arrival information. Thus, after identifying occasions on which anticipated travel includes travel among time zones, the clock is automatically changed in response to detecting coincidences with the timing of such occasions.

The dynamic time-of-day adjustments include the step of receiving the itinerary. In one embodiment, the user enters the departure and arrival information by means of a user interface mechanism. For example, if the portable processing device is a laptop computer, the user interface mechanism may be a keyboard. In another embodiment, the itinerary is downloaded from another processing device, such as a desktop computer. Thus, the portable processing device can be "hotsynced" with a stationary processing device having a compatible calendar program. As a third alternative, the travel schedule may be received in an electronic itinerary messaging format, so that if a customer has made airline or hotel reservations electronically, the information can be downloaded directly to a calendar program of the portable processing device, without requiring the user to manually enter the information.

The invention also includes a step of determining the relevant time zones. In one application, there is a database stored within the portable processing device. The database may include geography-based and time zone-based information. For example, a database application that includes a list of cities and the time differentials relative to Greenwich Mean Time may be employed. A more extensive database may be used, if the database is available via a network. When such a database is not locally or remotely accessible, the portable processing device may include a software module which prompts the user to enter the time zone information as travel information is entered.

As another step, the dynamic adjustments of the time-of-day clock are correlated with the departure and arrival information of the itinerary. Preferably, the clock adjustments occur en route of the travel anticipated by the itinerary. For example, the adjustments may be triggered by recognizing that a departure time or an arrival time has been reached. The adjustments may be in one hour increments, but other increments are contemplated. For example, if departure and arrival information indicate that there is an eight hour time difference that will be encountered over a ten hour time period, time zone increment tokens of 1.25 hours (10/8) may be stored in a calendar program. Each token indicates that at that moment, there is a crossing from one time zone to a next time zone. Although this method is not precise, it is sufficiently close for purposes of the dynamic clock adjustment. Similar tokens may be automatically stored for the return trip, although the tokens will be time zone decrements rather than increments.

Another feature of the invention is the display capability. In the preferred embodiment, there are at least two displayed times. A first time is referred to as the reference time. The reference time is the time at a particular geographical location, such as the home city of the user. In the embodiments in which reference time is tracked, the reference time is not dynamically adjusted for travel. Instead, a second displayed time is dynamically adjusted in correlation with arrival and departure information of the itinerary. All reminders, alarms and ToL functionality are based on the second (local) time, rather than the reference time.

The portable processing device may be a laptop computer, PDA or other device in which maintaining time synchronization is important. The invention is particularly suitable for applications in which a user relies on a portable processing device for calendaring, messaging and ToL functionality. Optionally, the device may be programmed to confirm the adjusted time by accessing an external source of information. If the device has a wireless connection to a network, the network can be polled to determine the local time, when protocol permits. Alternatively, devices that are equipped with GPS locators can use GPS signals to confirm the adjusted time. In like manner, a GSM system could be used to confirm the time zone based on determining the location of the antenna/base station that is accessed by the portable processing device, such as when the device is a cellular phone.

DETAILED DESCRIPTION

Figure 1:
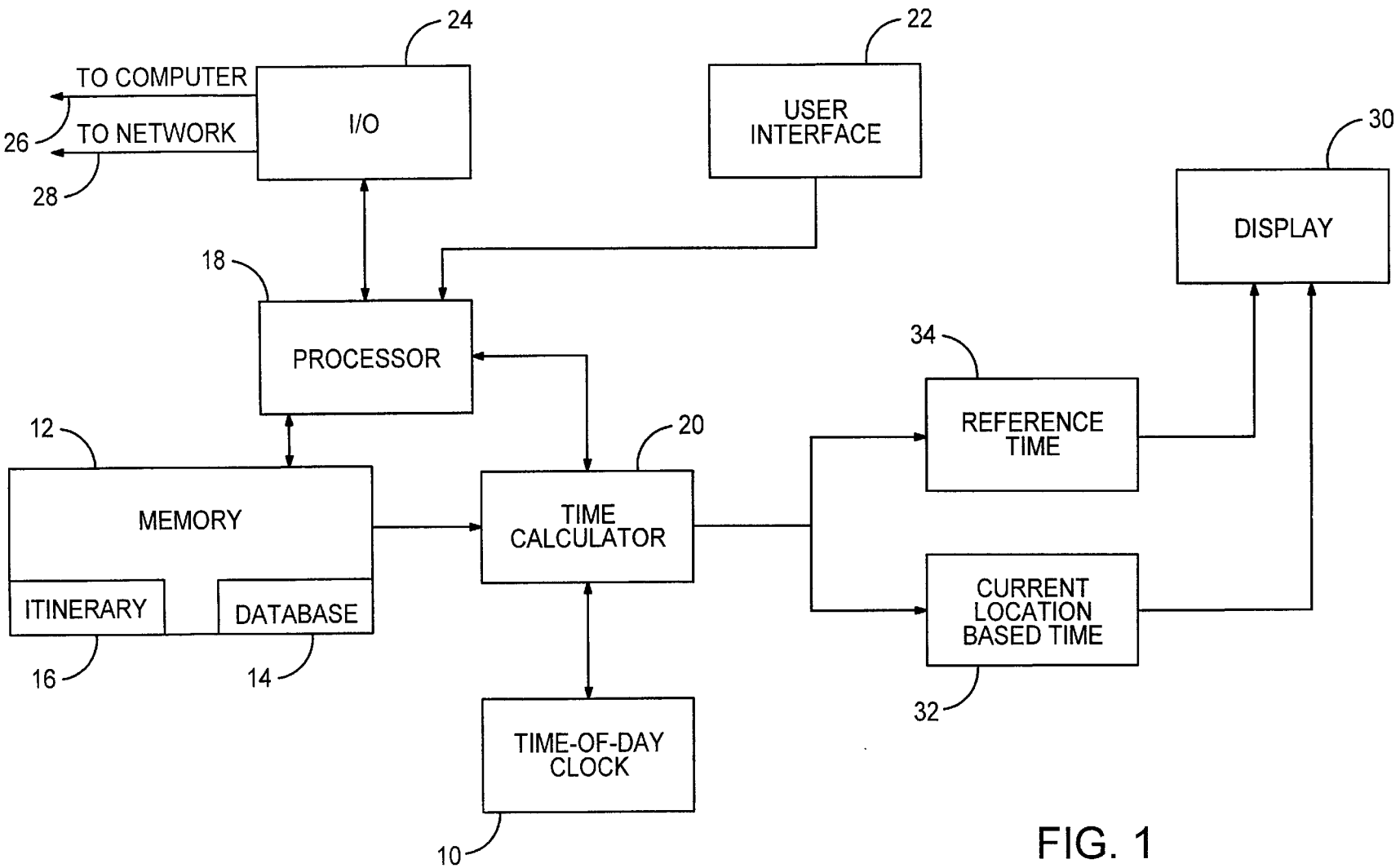
FIG. 1 is a block diagram of a portable processing device in accordance with the invention.

With reference to FIG. 1, components of one embodiment of a portable processing device having a dynamically adjustable time-of-day clock 10 are shown. The device may be a laptop computer, a PDA, a watch, a cellular phone, or any other portable device that is relied upon for determining time. For example, the device may be a telephony-enabled laptop computer that is addressable by a ToL system in forwarding calls or allowing calls to ring through, based upon the time of day. Thus, if a traveler with a laptop computer is in a time zone different than the time zone of a home office, the selection to alert the traveler that an incoming call is available should be based upon the time at the physical location of the traveler, rather than the physical location of the home office. The desired operation of the computer when it is connected to a hotel LAN port or a phone port or when it is wirelessly accessible depends upon the accuracy of the time-of-day clock 10.

In the preferred embodiment, the portable processing device includes memory 12 having an internal database 14 and an itinerary program 16. The itinerary program may be a conventional electronic calendar that is accessible by a personal information manager program executed by a processor 18. As will be explained more fully below, the stored itinerary 16 includes a travel schedule of departure and arrival information. The arrival and departure information may be the dates and times of airline flights, hotel reservations, vehicle rental reservations, and similar travel-related events.

The information in the database 14 may be a list of cities and the time zones associated with each city. Greenwich Mean Time (GMT) may be used as a standard, so that each city is identified as having a time difference relative to GMT. Thus, a time-of-day clock adjustment may be determined by converting the known time at the home office to GMT and then comparing the GMT to the time in the city in which the user is physically located. The device of FIG. 1 includes a time calculator 20 for performing such determinations.

The device also includes a user interface mechanism 22. The mechanism may be a keyboard, computer mouse, trackball, or similar device for allowing a user to enter information to the device. Thus, a user can input information to the itinerary program 16 or the database 14 or can respond to prompts that are presented to the user when itinerary information is input.

An input/output (I/O) mechanism 24 may be connected to another processing device, such as a computer, or to a network. The I/O mechanism is a conventional component that may include a first port 26 for connection to a computer and a second port 28 for connection to a network. If the device does not include the internal database 14, an external database may be accessed by the device using either the first port 26 or the second port 28. Moreover, the ports may be used to input the travel schedule stored at the itinerary 16. In one application of this feature, the user of the device enters the information into the itinerary 16 of the portable device by linking the device to a laptop or desktop computer having the information. The two computers can then be "hotsynced," if the computers utilize compatible software, such as a Personal Information Manager (PIM) program with an electronic calendar. In another application of this feature, the second port 28 is used to connect the device to a network from which electronic itinerary messaging can be received. For example, if a customer receives an electronic confirmation via the global communications network referred to as the Internet, the confirmation may be the source of the travel information to the itinerary. This download would reduce the need of the user entering the information via the user interface mechanism 22. In another application of this feature, the portable device is network attached (e.g., a connection to a LAN), so that travel information can be received from a central facility.

In the preferred embodiment, the portable processing device is configured such that a display is able to show two times. The first displayed time identifies the time-of-day in the geographical location in which the user is determined to be physically located, based upon the information in the itinerary 16. This current location-based time is represented by component 32. The second displayed time is a reference time, as represented by component 34. As an example, the reference time may be displayed in parentheses next to or below the current location-based time. This allows the user to easily determine time-of-day at the location at a home office, if a call to the office is necessary. However, any reminders, alarms, or ToL functionality of the portable processing device will operate according to the current location-based time. Thus, no early morning phone calls will trigger an audible alert that an incoming call is available.

The process steps for executing the dynamic clock adjustment of the device of FIG. 1 will be described with reference to FIG. 2. In step 36, the time-of-day clock 10 is set. Typically, a user will set the clock based upon the time at the location in which the user first acquires the device. However, this is not critical. The execution of step 36 is not significant to the invention. Nevertheless, in the preferred embodiment, the device maintains a reference time and a dynamically adjusted time. The reference time is typically established in step 36, while the adjusted time is based upon step 36 and upon travel of the device.

In step 38, the itinerary is input into the device. The itinerary includes departure and arrival information. The device is unable to determine whether actual travel occurs. Thus, the dynamic adjustment that is calculated by the time calculator 20 is based upon "anticipated travel," rather than actual travel. In some embodiments, the dynamic adjustment of the time-of-day clock 10 will lead to a display of inaccurate time information, if a user postpones a trip without updating the information in the itinerary 16 of the memory 12. However, in other applications the device is enabled to confirm the adjusted time. For example, devices that are equipped with GPS locators can use GPS signals to confirm the adjusted time. Similarly, a GSM system can be used to calculate the time zone based on the location of an antenna/base station that is accessed by the portable processing device, such as when the device is a cellular telephone.

In step 40, a coincidence between the clock and the timing of an anticipated trip is identified. That is, when the time-of-day clock 10 reaches a date on which a trip is scheduled, as indicated by the information in the itinerary 16, the dynamic adjustment process is initiated. Preferably, the clock adjustment occurs simultaneously with the trip, so that the adjustment occurs en route. For example, at the time that an airline flight is scheduled to depart, as indicated in the itinerary 16, the step 42 of determining whether the trip involves travel in more than one time zone is implemented. If the trip involves only one time zone, no clock adjustment is necessary. Consequently, the process returns to the step 40 of identifying a coincidence between a scheduled trip and the time-of-day clock. On the other hand, if the trip involves more than one time zone, a step 44 of adjusting the clock is implemented.

The execution of the clock adjustment at step 44 is preferably incremental. That is, while the clock may be adjusted in a leap forward or backward to the appropriate time at the destination, the preferred embodiment is one in which tokens are added or subtracted while the trip is in progress. This preferred embodiment is particularly useful when the portable processing device is used during travel, such as when a laptop computer is used during a flight. The adjustment may be in one hour increments, but other increments are contemplated. As an example, a user may have used Pacific Standard Time in setting the clock in step 36 and may have a ten hour flight from San Francisco to London, with the flight leaving San Francisco at 2:00 PM local time and arriving in London at 8:00 AM London time. Since the eight hour time difference is encountered over a ten hour period, a time zone increment token may be stored every 1.25 hours (10/8). Each stored token indicates a crossing from one time zone to a next time zone. While the process is not precise, it is sufficiently close in most uses. Upon arrival, the reminders, alarms and ToL functionality will function according to London time. The display of time will indicate the London time, but the reference time is preferably also displayed, as indicated at step 46. When returning from London, time zone decrement tokens are generated, similar to the time zone increment tokens during the original airline flight.

Figure 2:
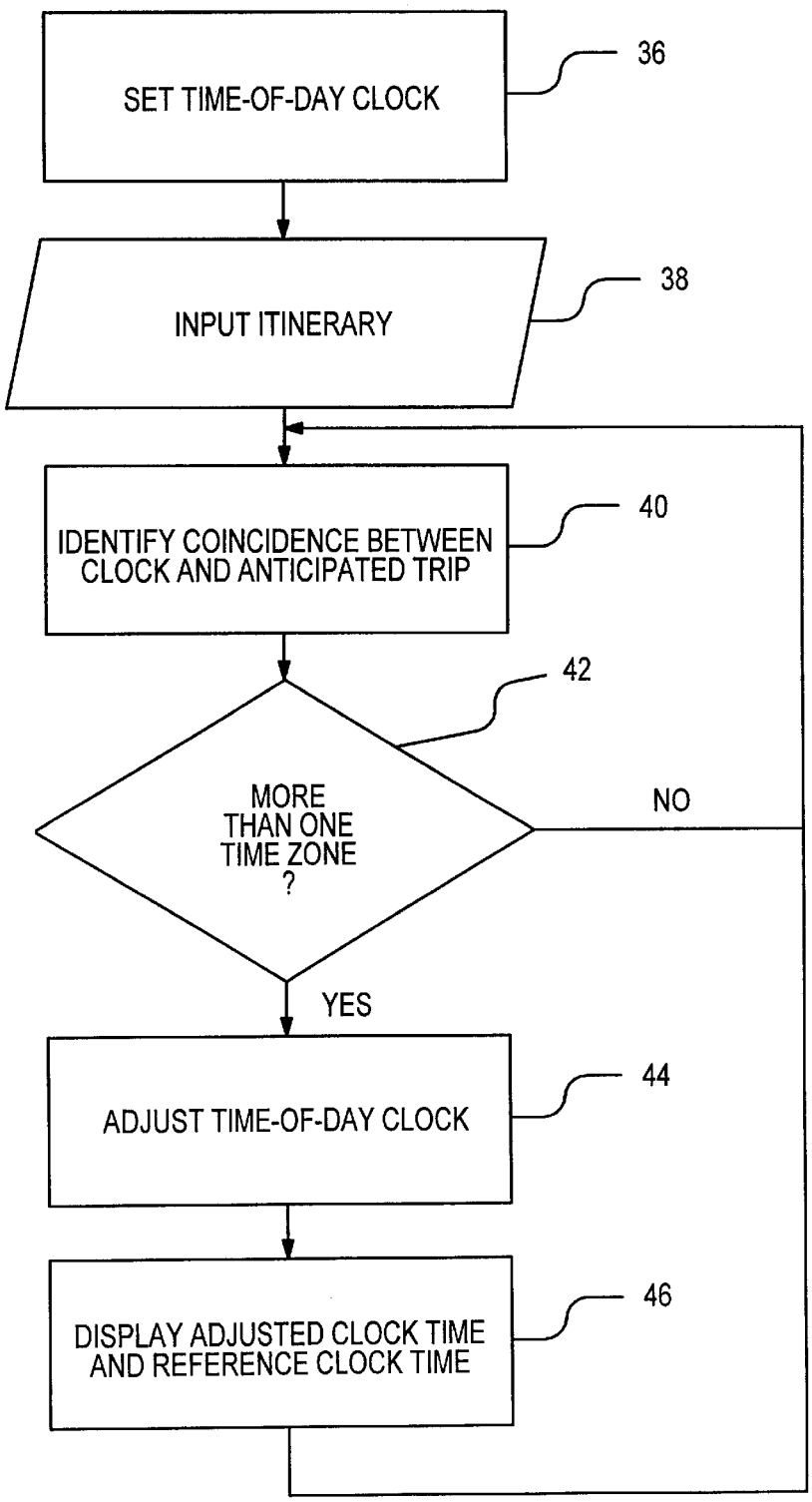
FIG. 2 is a process flow of steps for dynamically adjusting a time-of-day clock in the device of FIG. 1.
Figure 3:
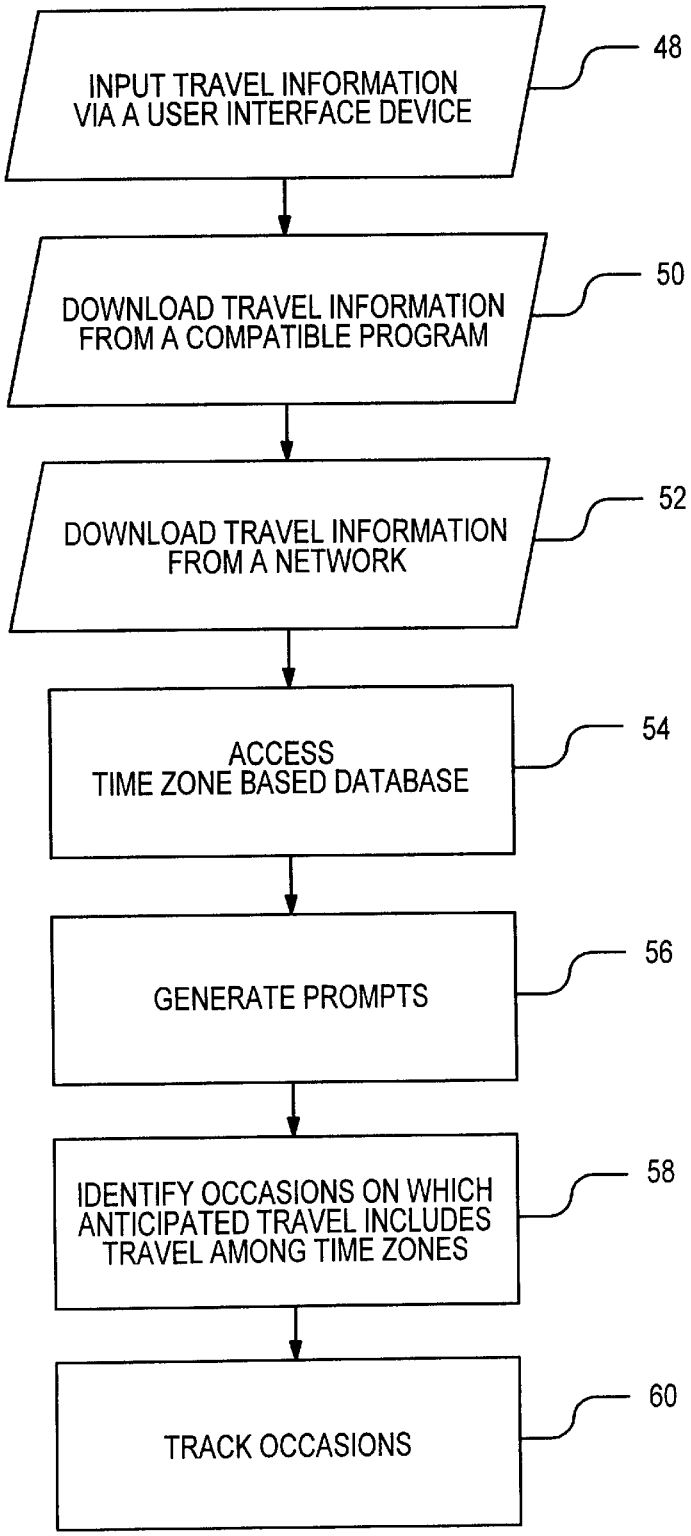
FIG. 3 is a process flow of steps for acquiring and processing information important to the implementation of the process of FIG. 2.

FIG. 3 illustrates optional and alternative steps for executing the FIG. 2 steps 38, 40 and 42 of inputting the itinerary and identifying coincidences between the occurrence of a trip and the present time. In step 48, a user inputs travel information via the user interface mechanism 22 of FIG. 1. This may include generating prompts, particularly if the portable processing device does not include the time zone-based database 14. Thus, the prompts may require a person to identify any time zone differences. Prompts may also be used to ensure accuracy in the input of information. When a user inputs appointments scheduled for a time in which a user will be in a city having a different time zone, the device may generate a prompt requesting a selection between the present time zone and the destination time zone. Other types of prompts may also be generated, as will be described with reference to step 56.

As an additional or alternative step to inputting the itinerary in step 48, the travel information may be downloaded from a compatible program of a second processing device. For example, the port 26 of FIG. 1 may be connected to a desktop computer in which a calendar program has been updated to include all of a known travel schedule. The download step 50 is sometimes referred to as a hotsync. As indicated at step 52, the travel information can additionally or alternatively be downloaded via a network. The network may be a private network, such as a LAN, or may be the global communications network referred to as the Internet. Airline, hotel and car rental reservations are sometimes confirmed electronically by means of transmissions over the Internet. These electronic confirmations may be downloaded and used to update the itinerary 16 in the memory 12.

Step 54 involves accessing a time zone-based database. In the preferred embodiment, the database is internal to the device, as indicated by the database 14 in memory 12 of FIG. 1. However, the database may also be centrally located if the device is network compatible. The access to a database allows the device to determine when travel information indicates that there will be a trip from one time zone to a second time zone. As described above, the database may be a list of cities and the time zones appropriate for those cities. As an alternative to using the database to identify multi-zone travel, a user may be prompted at step 56 to input identifications of relevant time zones when the travel information is entered. Requiring a user to identify the time zones is more time consuming and is more prone to error than the previously described techniques, but manual entry may be helpful, since the database cannot be exhaustive.

In step 58, the occasions on which anticipated travel includes multi-zone travel are identified. This is a continuation of the step of accessing the time zone-based database 54 and generating the time zone-based prompts 56. The occasions of multi-zone travel can be tagged in memory in order to facilitate the step 60 of tracking the occurrences of the occasions.

An advantage of the invention is that the device and method do not require a user to regularly update a time-of-day clock. Instead, the appointments that are entered into an electronic calendar are automatically used to dynamically adjust the clock when appropriate.

What is claimed is:

1. A portable processing device comprising:

a time-of-day clock;

memory having stored information indicative of calendar activities that include at least one of reminders and alarms, said memory further including a travel schedule that includes departure and arrival information; and processing means in communication with said memory for automatically updating said calendar activities and said time-of-day clock based upon determinations that said travel schedule identifies travel that includes at least two time zones, said processing means being configured to initiate said updating as direct automated responses to accessing said departure and arrival information stored in said memory.

2. The portable processing device of claim 1 wherein said memory stores said departure and arrival information to include zone-based data that enables said processing means to determine time-of-day clock and calendar activities updates based upon correlations between said zone-based data and said departure and arrival information.

3. The portable processing device of claim 2 wherein said memory stores said travel schedule as an itinerary and stores said zone-based data as a database of geographical locations and time zones for said geographical locations, said processing means being configured to correlate said itinerary with said database and to coordinate updates of said time-of-day clock with correlations between said itinerary and time zone changes relevant to said itinerary.

4. The portable processing device of claim 1 further comprising a display means responsive to said processing means for visually displaying an updated time and a reference time, said updated time being indicative of said updating of said time-of-day clock, said reference time being indicative of a time within a selected time zone and being isolated from said updating based upon said travel.

5. The portable processing device of claim 1 further comprising an input means for receiving said travel schedule from a network connection.

6. The portable processing device of claim 5 wherein said input means includes a connection to a commercial website of the World Wide Web.

7. The portable processing device of claim 5 wherein said input means is an input/output port compatible with connection to a computer having a calendar program.

8. The portable processing device of claim 1 wherein said processing means is configured to incrementally update said time-of-day clock based upon said time zone changes, said incremented updates being triggered to coincide with travel represented in said travel schedule.

9. The portable processing device of claim 1 further comprising means for prompting user inputs of information as said travel schedule is input to said memory.

10. A method of automatically updating a clock and a calendar program containing calendar activities that include time-specific appointments of a portable device comprising steps of:

storing travel information specific to anticipated travel of said portable device;

identifying occasions on which said anticipated travel includes travel among time zones; and automatically changing said clock and said calendar activities in response to detecting that a time indicated by said clock has at least reached timing of one of said occasions, including varying said clock and said calendar activities based upon occurrences of said anticipated travel.

11. The method of claim 10 wherein said step of automatically changing includes incrementing and decrementing said clock and said calendar activities in correlation with in-route movement of said portable device, including basing timing of said in-route movement upon said anticipated travel across time zones.

12. The method of claim 11 wherein each occurrence of said steps of incrementing and decrementing is implemented provides a time change not exceeding one hour, said time change compensating for said anticipated travel from a first time zone to a second time zone.

13. The method of claim 10 wherein said step of automatically changing is based solely upon time-based processing within said portable device.

14. The method of claim 10 wherein said step of storing said travel information includes downloading said travel information from a global communications network.

15. The method of claim 10 further comprising a step of selectively displaying a reference time and an updated time, said reference time being indicative of the time-of-day in a selected time zone and said updated time being responsive to said automatic changing of said clock.

16. The method of claim 15 further comprising a step of requesting selections among time zones when said travel information is input to said portable device, said selections being related to times at different geographical locations specified in said travel information.

17. A method of automatically updating a clock and a calendar program having calendar activities of a portable device comprising steps of:

maintaining an internal time-of-day clock;

maintaining a calendar program to include time sensitive reminders and alarms and information indicative of geographical locations in which said portable device is anticipated to be as of specific dates;

automatically adjusting said time-of-day clock based upon said information of said calendar program, including changing said time-of-day clock in response to detecting that a specific date has been reached on which a change in said geographical location of said portable device results in a change in time zones; and displaying both said automatically adjusted time-of-day clock and an unadjusted reference time-of-day clock that is indicative of time that is tracked in isolation of said step of automatically adjusting.

18. The method of claim 17 further comprising a step of maintaining a database in which geographical locations are correlated with time-of-day information, said step of automatically adjusting including accessing said calendar program and said database to determine specific dates in which said changes in said geographical locations result in changes in time zones.

* * * * *